US005243685A

United States Patent [19]

Laurent

[11] Patent Number: 5,243,685

[45] Date of Patent: Sep. 7, 1993

[54] METHOD AND DEVICE FOR THE CODING OF PREDICTIVE FILTERS FOR VERY LOW BIT RATE VOCODERS

[75] Inventor: Pierre-André Laurent, Bessancourt, France

[73] Assignee: Thomson-CSF, Puteaux, France

[21] Appl. No.: 606,856

[22] Filed: Oct. 31, 1990

[30] Foreign Application Priority Data

Nov. 14, 1989 [FR] France ..... 89 14897

[51] Int. Cl.[5] ..... G10L 9/02

[52] U.S. Cl. ..... 395/2

[58] Field of Search ..... 381/29-41, 381/51; 375/25-27, 34, 122; 395/2; 358/136

[56] References Cited

U.S. PATENT DOCUMENTS 4,797,925 1/1989 Lin ..... 381/31
4,817,157 3/1989 Gerson ..... 381/40
4,852,179 7/1989 Fette ..... 381/29
4,853,780 8/1989 Kojima et al. ..... 358/136
4,868,867 9/1989 Davidson et al. ..... 381/36
4,963,034 10/1990 Cuperman et al. ..... 381/35

OTHER PUBLICATIONS

IEEE Transactions on Acoustics, Speech and Signal Processing, vol. ASSP—31, No. 3, Jun. 1983, pp. 706-713, IEEE, New York, US; P. E. Papamichalis et al.: "Variable rate speech compression by encoding subsets of the PARCOR coefficients".

*Primary Examiner*—Michael R. Fleming
*Assistant Examiner*—Michelle Doerrler
*Attorney, Agent, or Firm*—Oblon, Spivak, McClelland, Maier & Neustadt

[57] ABSTRACT

A method of breaking up a vocal signal into binary frames of a predetermined duration. The frames are grouped together in packets of successive frames by associating a predictive filter with each frame of a packet. Furthermore, the coefficients of each predictive filter are quantified by taking into account the stable or non-stable configuration of the vocal signal.

9 Claims, 3 Drawing Sheets

FIG_1 PRIOR ART
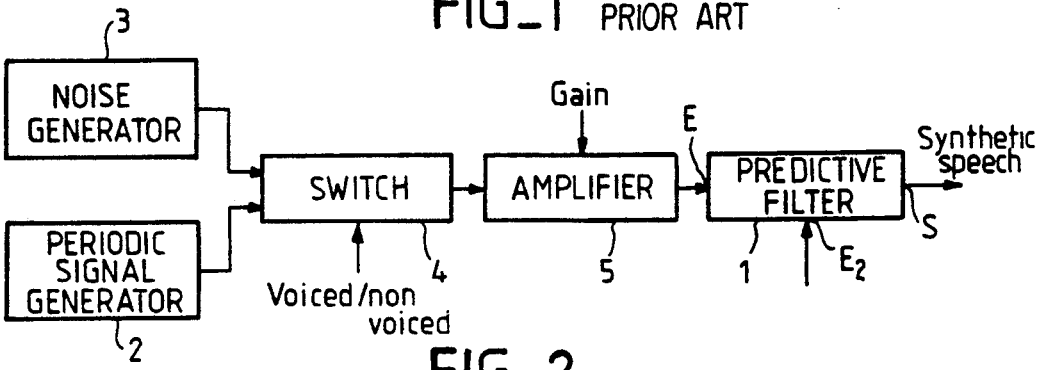
FIG_2
| Configuration N° | Configuration bits | Configuration Frame1 | Frame2 | Frame3 | Comments |
|---|---|---|---|---|---|
| 1 | 0 0 | $F_1$ | $F_1$ | $F_1$ | 3 Filters identical |
| 2 | 0 1 | $F_1$ | $F_1$ | $F_2$ | First 2 filters identical |
| 3 | 1 0 | $F_1$ | $F_2$ | $F_2$ | Last 2 filters identical |
| 4 | 1 1 | $F_1$ | $F_2$ | $F_3$ | Filters all different |
FIG_4
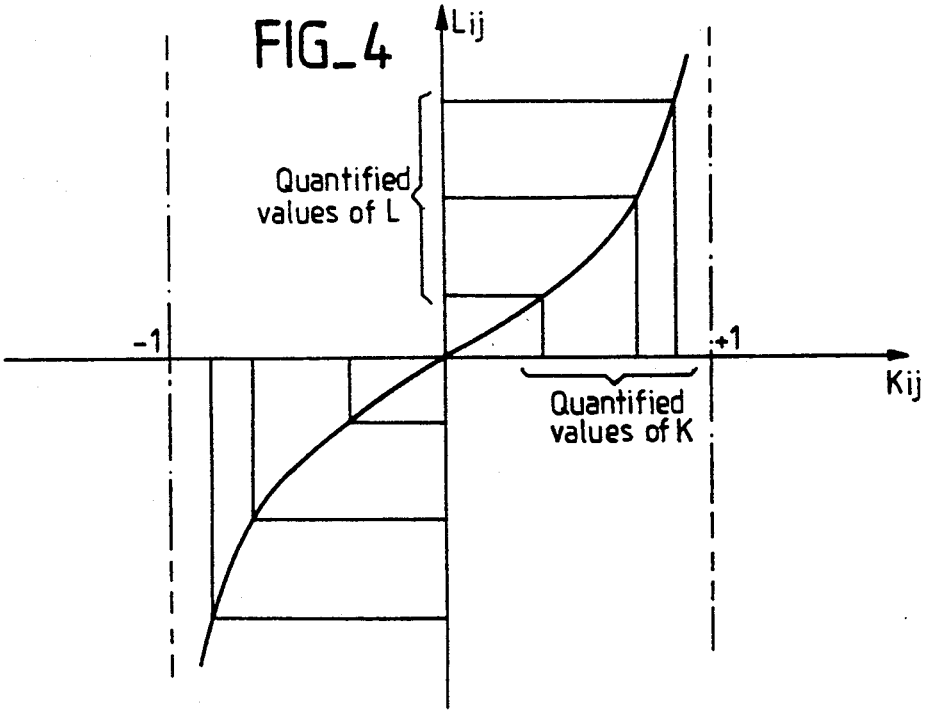

METHOD AND DEVICE FOR THE CODING OF PREDICTIVE FILTERS FOR VERY LOW BIT RATE VOCODERS

BACKGROUND OF THE INVENTION

1. Field of the Invention

The present invention concerns a method and a device for coding predictive filters for very low bit rate vocoders.

2. Description of the Prior Art

The best known of the methods of digitization of speech at low bit rate is the LPC10 or "linear predictive coding, order 10" method. In this method, the speech synthesis is achieved by the excitation of a filter through a periodic signal or a noise source, the function of this filter being to give the frequency spectrum of the signal a waveform close to that of the original speech signal.

The major part of the bit rate, which is 2400 bits per second, is devoted to the transmission of the coefficients of the filter. To this end, the binary train is cut up into 22.5 millisecond frames comprising 54 bits, 41 of which are used to adapt the transfer function of the filter.

A known method of bit rate reduction consists in compressing the 41 bit associated with a filter into 10 to 12 bits representing the number of a pre-defined filter, belonging to a dictionary of $2^{10}$ to $2^{12}$ different filters, this filter being the one that is closest to the original filter. This method has, however, a first major drawback which is that it calls for the construction of a dictionary of filters, the content of which is closely dependent on the set of filters used to form it by standard data processing techniques (clustering), so that this method is not perfectly suited to the real conditions of picking up sound. A second drawback of this method is that, to be applied, it requires a very large-sized memory to store the dictionary ($2^{10}$ to $2^{12}$ packets of coefficients). Correlatively, the computation times become lengthy because the filter closest to the original filter has to searched for in the dictionary. Finally, this method does not enable the satisfactory reproduction of stable sounds. This is because, for a stationary sound, the LPC analysis in practice never selects the same filter twice in succession but successively chooses filters that are close but distinct in the dictionary.

Just as, in television, where the reconstruction of a color image depends essentially on the quality of the luminance signal and not on that of the chrominance signal which may consequently be transmitted with a lower definition, it appears, also in speech synthesis, that it is enough to reproduce only the contour of the energy of the vocal signal while its timbre (voicing, spectral shape) are less important for its reconstruction. Consequently, in known speech synthesis methods, the process of searching for spectra, based on the change in the minimum distance between the spectra of the original speech (of the speaker) and the synthetic speech is not wholly warranted.

For example, different examples of the sound "A" pronounced by different speakers or recorded under different conditions may have a high spectral distance but will always continue to be "A"s that cam be recognized as such and, if there is any ambiguity, in terms of a possibility of confusion with its neighboring sound, the listener can always make the correction from the context by himself. In fact, experience shows that in devoting no more than about 30 bits to the coefficients of the predictive filter instead of 41, the quality of restitution remains satisfactory even if a trained listener should perceive a slight difference among the synthesized sounds with the predictive coefficients defined on 30 or 41 bits. Furthermore, since the transmission is done at a distance, and since the intended listener is therefore not in a position to make out this difference, it would appear to be enough for the listener to be capable of understanding the synthesized sound accurately.

It would also appear to be important that, in the stable parts of the signal (the vowels), the predictive filter should remain stable and be as close as possible to the original predictive filter. By contrast, in the unstable parts (such as transitions or unvoiced sound), the transmitted predictor does not need to be a faithful copy of the original predictor.

It is an aim of the invention to overcome the abovementioned drawbacks.

SUMMARY OF THE INVENTION

To this effect, an object of the invention is a method for the coding of predictive filters of very low bit rate vocoders of the type in which the vocal signal is cut up into binary frames of a determined duration, a method wherein said method consists in grouping together the frames in packets of successive frames, in associating a predictive filter respectively with each frame contained in a packet, and in quantifying the coefficients of each predictive filter in taking account of the stable or nonstable configuration of the vocal signal.

BRIEF DESCRIPTION OF THE DRAWINGS

Other characteristics and advantages of the invention will appear here below from the following description, made with reference to the appended drawings, of which:

FIG. 1 is a block diagram of a prior art speech synthesizer;

FIG. 2 shows, in the form of tables, the four possible codings of the predictive filters of the vocoder according to the invention;

FIG. 4 shows a graph of transformation of the reflection coefficients of the predictive filters;

DETAILED DESCRIPTION OF THE INVENTION

Figure 3:
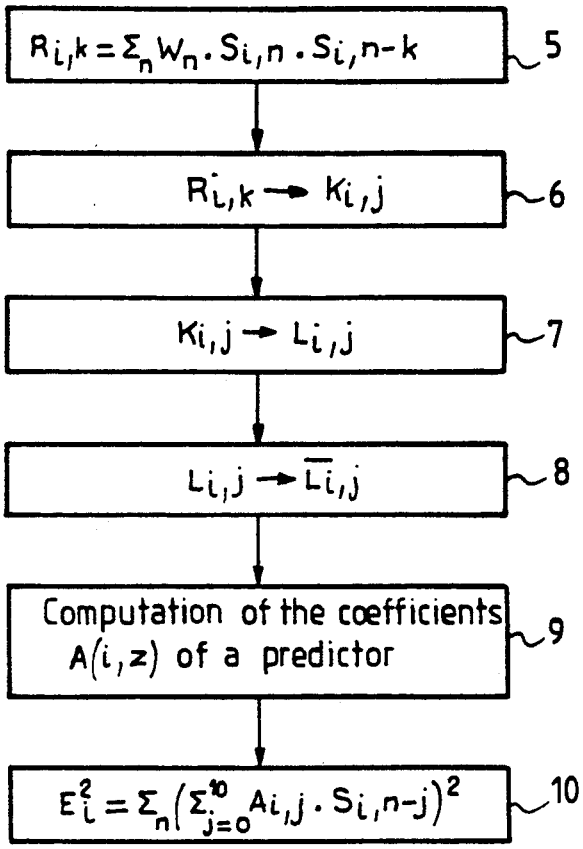
FIG. 3 is a flow chart used to illustrate the computation of the prediction error of the predictive filters applied by the invention.
Figure 5:
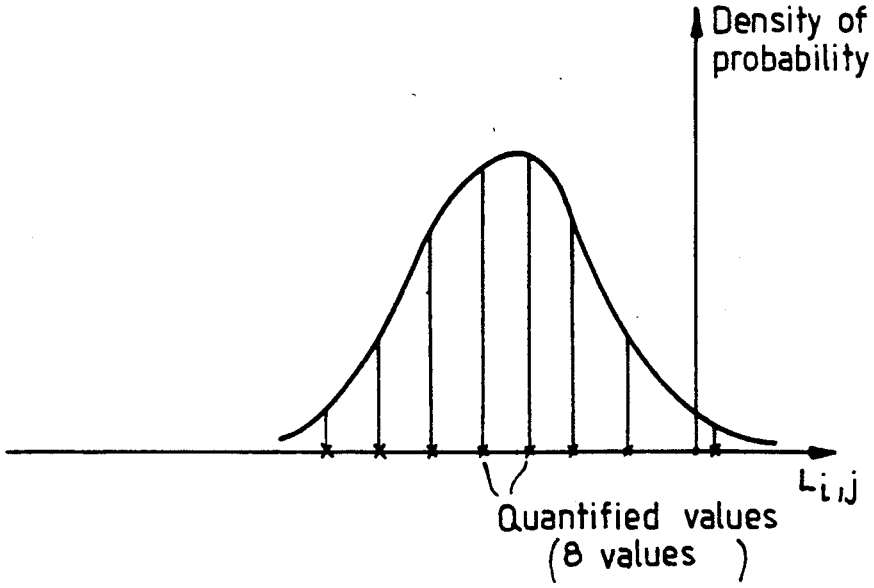
FIG. 5 represents the relationship of quantification of the reflection coefficients of the filters transformed by the graph of FIG. 3.

The speech synthesizer shown in FIG. 1 includes, in a known way, a predictive filter 1 coupled by its input $E_1$ to a periodic signal generator 2 and a noise generator 3 through a switch 4 and a variable gain amplifier 5 connected in series. The switch 4 couples the input of the predictive filter 1 to the output of the periodic signal generator 2 or to the output of the noise generator 3 depending on whether nature of the sound to be restored is voiced or not voiced. The amplitude of the sound is controlled by the amplifier 5. At its output S, the filter 1 restores a speech signal as a function of prediction coefficients applied to its input $E_2$. Unlike what is shown in FIG. 1, the speech synthesizers to which the method and coding device of the invention are applicable should have three predictive filters 1 matched with each group of three successive 22.5 ms frames of the speech signal depending on the stable or non-stable state of the sound that is to be synthesized. This organization enables, for example, a reduction in the bit rate from 2400 bits per second to 800 bit rates per second, by grouping the frames together in packets of 3×22.5 67.5 milliseconds of 54 bits. Of these bits, 30 to 35 bits are used to describe, for example, the 10 predictive coefficients of the three successive filters needed to apply the LPC10 coding method described above, and two bits of these 30 to 35 bits are used to define the configuration to be given to the three filters to be generated depending on whether the nature of the vocal signal to be generated is stable or not stable. In the table of FIG. 2, which contains the four possible configurations of the three filters, there corresponds, to the state 00 of the two configuration bits, a first configuration where the three predictive filters are identical for the three frames of the vocal signal. For the second configuration, the configuration bits have the value 01 and only the first two filters of the frames 1 and 2 are identical. In the third configuration, corresponding to the configuration of 10 bits, only the last two filters of the frames 2 and 3 are identical. Finally, in the fourth configuration, corresponding to the configuration of 11 bits, the three filters of the frames 1 and 3 are different. Naturally, this configuration mode is not unique and it is equally well possible, while remaining within the framework of the invention, to define the number of frames in a packet by any number. However, for convenience of construction, this number could be a number from 2 to 4 inclusively. In these cases, naturally, the number of configurations possible could be extended to 8 or 16 at the maximum. The definition of the filters is established according to the steps 1 to 6 of the method depicted by the flow chart of FIG. 2. According to a first step of the method bearing the reference 5 on the flow chart, the self-correlation coefficients $R_{i,k}$ of the signal are computed according to a relationship having the form:

$$R_{ik} = \sum_n W_n \cdot S_{in} \cdot S_{i,n-k} \tag{1}$$

where $S_{in}$ is a sample n of the signal in the frame i and $W_n$ designates the weighting window. At the second step, referenced 6, the computation of the reflection coefficients of the predictive filter in lattice form corresponding to the preceding coefficients Ri(k) is done by applying a standard algorithm, for example the known algorithm of LEROUX-GUEGUEN or SCHUR. At this stage, the coefficients $R_{ik}$ are transformed into coefficients $K_{ij}$ where j is a positive integer taking the successive values of 1 to 10. At the third step, bearing the reference 7, the coefficients k, the values of which range by definition from −1 and +1, are transformed into modified coefficients which change between "−infinite" and "+infinite" and take account of the fact that the quantification of the coefficients k should be faithful when they have an absolute value close to 1 and may be more approximate when their value is close to 0 for example. Each coefficient $K_{ij}$ is, for example, transformed according to a relationship having the form:

$$L_{ij}=K_{ij}/(1-K_{ij}^2)^{-2} \tag{2}$$

the graph of which is shown in FIG. 3 or, again according to the relationships:

$$(L_{ij}=K_{ij}|1-|K_{ij}|);\ (L_{ij}=\text{arc cos } K_{ij});\ (L_{ij}=\text{arc sin } K_{ij})$$

or again application of the LSP coefficients computing method described by George S. Kang and Lawrence J. Fransen in the article "Application of Line Spectrum Pairs to Low Bit Rate Speech Encoder", Naval Research Laboratory DC 20375, 1985. At the fourth step, shown at 8, the coefficients $L_{ij}$ are quantified in $n_j$ bits each non-uniformly in taking account of the distribution of the coefficients to give a value $L_{ij}$ according to a relationship of distribution represented by the histogram of the $L_{ij}$ coefficients of FIG. 4. At the step 5, the values of $\overline{L_{ij}}$ are, in turn, used to compute the coefficients $\overline{K_{ij}}$ according to the relationship:

$$\overline{K_{ij}}=\overline{L_{ij}}/(1+L_{ij}^2)^{-2} \tag{3}$$

These values $\overline{K_{ij}}$ represent the quantified values of the prediction coefficients, on the basis of which the coefficients of a predictor $A_{i(z)}$ may be deduced by recurrence relationships defined as follows:

$$\overline{A_i}^{-o}(z)=1 \tag{4}$$

$$\overline{A_i}^{p}(z)=\overline{A}^{p-1}(z)+\overline{K_{i,p}}Z^{31\ p}\overline{A_i}^{p-1}(z^{-1}) \tag{5}$$

for p=1, 2, . . . 10. with $$A_i(z)=\overline{A_i}^{10}(z)=A_{io}+A_{il}Z^{-1}k+\ldots+A_{i,10}Z^{-10}$$

Finally, at the last step shown at 10, the computation of the energy of the prediction error is computed by the application of the following relationship:

$$E_i^2 = \sum_n \left( \sum_{j=0}^{10} A_{i,j} S_{i,n-j} \right)^2 \tag{7}$$

or again $$E_i^2 = R_{io}B_{io} + 2 = \sum_{j=1}^{10} R_{i,j}B_{i,j} \tag{8}$$

with $$B_{i,o} = \sum_{m=0}^{10} A_{i,m}^2$$

$$B_{ij} = \sum_{m=0}^{10} A_{i,m}A_{i,m+j}$$

To complete the algorithm, it is enough then to test the four different configurations described above by interposing an additional step, between the first and second steps of the method, said additional step taking account of the possible configurations to finally choose only the configuration for which the total prediction error obtained is minimal (summed on the three frames).

In the first configuration, the same filter is used for all three frames. Then, for the progress of the steps 2 to 6, a fourth single fictitious filter is used. This fourth filter is computed from the coefficients $R_{4j}$ given by the relationship $$R_{4j}=R_{ij}+R_{2j}+R_{3j} \qquad j(9)$$

with j varying from 0 to 10.

The total prediction error is then equal to $E_4^2$ and the algorithm of the method amounts, in fact, to considering the three frames as a single frame with a duration that is three times greater.

The coefficients L1 to L10 may then be quantified with, for example, 5,5,4,4,4,3,2,2,2,2, bits respectively, giving 33 bits in all.

According to the second configuration, in which one and the same filter is used for the frames 1 and 2, the algorithm is done with values of the self-correlation coefficients $R_{5j}$ and $R_{3j}$ defined as follows:

$$R_{5,j}=R_{1,j}+R_{2,j}$$

where j successively takes the values of 1 to 10 for the first two frames and $R_{3,j}$ (j varying from 1 to 10) for the last frame.

The prediction error is equal to $E_5^2+E_3^2$. This amounts to considering the frames 1 and 2 as being grouped together in a single frame with a double duration, the frame 3 remaining unchanged. It is then possible to quantify the coefficients $L_1$ to $L_{10}$ on the frames 1 and 2 with, respectively, 5,4,4,3,3,2,2,2,2,0,0 bits (25 bits in all, the coefficients $L_9$ and $L_{10}$ then being not transmitted), and their variation to obtain those of the third frame in using 3,2,2,1,0,0,0,0,0,0 bits respectively (8 bits in all), giving 33 bits for all three frames.

The fact of not transmitting the coefficients $L_9$ and $L_{10}$ is not inconvenient since, in this case, the configuration corresponds to predictors which change and have coefficients with an importance that decreases as a function of their rank.

In the third configuration, where the same filters are used for the frames 2 and 3, the same method as in the second configuration is used in grouping together the coefficients $R_{ij}$ of the frames 2 and 4 such that $R_{6j}=R_{2j}+R_{3j}$. The same method of quantification is used but in coding the predictor of the frames 2 and 3 and the differential for the frame 1.

Finally, for the last configuration, where all the filters are different, it must be considered that the three frames are uncoupled and that the total error is equal to $E_1^2+E_2^2+E_3^2$. In this case, the coefficients $L_1$ to $L_{10}$ of the frame 2 will be quantified with, respectively, 4,4,3,3,3,2,2,0,0 bits, giving 21 bits, as well as the differences for the first frame with 2,2,1,1,0,0,0,0,0,0 bits, giving six bits, as well as the differences for the frame 3 (six additional bits). This last configuration corresponds to an encoding of 21+6+6=33 bits.

Figure 6:
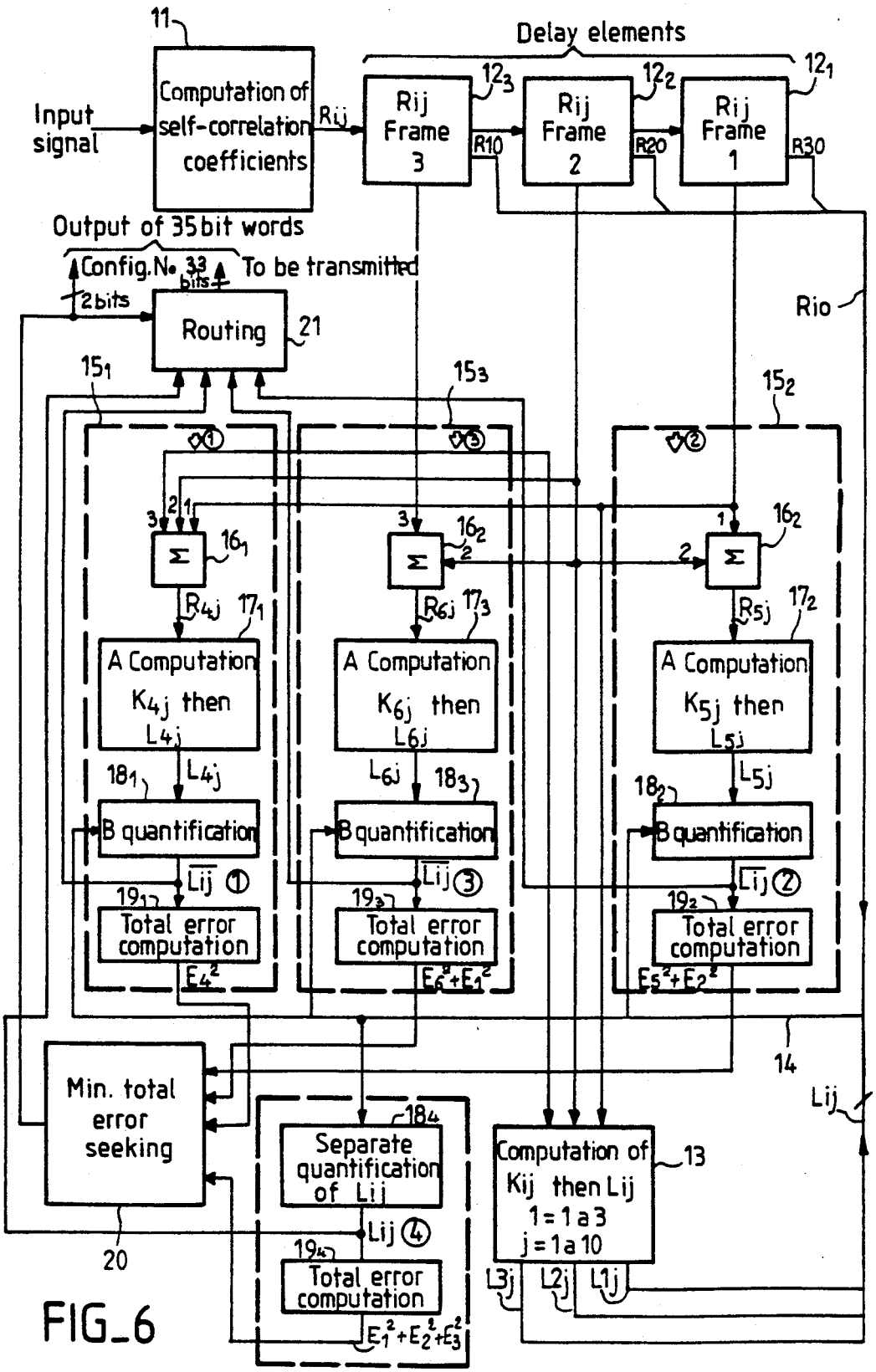
FIG. 6 shows a device for the application of the method according to the invention.

The device for the implementation of the method which is shown in FIG. 6 includes a device 1 for the computation of the the self-correlation coefficients for each frame coupled with delay elements formed by three frame memories $\mathbf{12}_1$ to $\mathbf{12}_3$ to memorize the coefficients $R_{ij}$ computed from the first step of the method. It also includes a device 13 for the computation of the coefficients $K_{ij}$ and $L_{ij}$ according to the second step of the method. A data bus 14 conveys the values of the coefficients $L_{ij}$ (i=1 to 3, j=1 to 10) and the values of the coefficients $R_{io}$ representing the energies where i=1 to 3. The data bus 14 connects the delay elements $\mathbf{12}_1$ to $\mathbf{12}_3$ and the computing device 13 has four computation chains referenced $\mathbf{15}_1$ to $\mathbf{15}_4$. The computation chains $\mathbf{15}_1$ to $\mathbf{15}_3$ respectively include a summator device, respectively $\mathbf{16}_1$ to $\mathbf{16}_3$, which is connected to the delay elements $\mathbf{12}_1$ to $\mathbf{12}_3$ to compute the coefficients $R_{4j}$, $R_{5j}$ and $R_{6j}$ according to the four configurations described above. The outputs of the summation devices $\mathbf{16}_1$ to $\mathbf{16}_3$ are connected to devices, respectively $\mathbf{17}_1$ to $\mathbf{17}_3$, for computing the coefficients $L_{4j}$, $K_{4j}$; $K_{5j}$, $L_{5j}$; and $K_{6j}$ and $L_{6j}$. The coefficients $L_{4j}$, $L_{5j}$, $L_{6j}$ are transmitted respectively to quantification devices $\mathbf{18}_1$ to $\mathbf{18}_3$ to compute the coefficients $\overline{L_{ij}}$ in accordance with the fourth step of the method. These coefficients are applied to total error computing devices respectively referenced $\mathbf{19}_1$ to $\mathbf{19}_3$ to respectively give total prediction errors $E_4^2+E_5^2+E_2^2$ and finally $E_1^2+E_6^2$ for each of the configurations 1 to 3 described above. The computation chain $\mathbf{15}_4$ includes, connected to the data bus 14, a separate quantification device $\mathbf{18}_4$ of the coefficients $L_{ij}$. The coefficients $\overline{L_{ij}}$ obtained at the output of the quantification device $\mathbf{18}_4$ are applied to a total error computation device $\mathbf{19}_4$ to compute the total error according to the above-defined relationship $E_1^2+E_2^2+E_3^2$. Each of the outputs of the total error computation devices $\mathbf{19}_1$ to $\mathbf{19}_4$ of the computation chains $\mathbf{15}_1$ to $\mathbf{15}_4$ is applied to the respective inputs of a minimum total error seeking device 20. Furthermore, each of the outputs of the quantification device $\mathbf{18}_1$ to $\mathbf{18}_4$, giving the coefficients $\overline{L_{ij}}$, is applied to a routing device 21 controlled by the output of the minimum total error seeking device 20 to select coefficients $\overline{L_{ij}}$ to be transmitted, which correspond to the minimum total error computed by the device 20. In this example, the output of the device includes 35 bits, 33 bits representing the values of the coefficients $\overline{L_{ij}}$ obtained at the output of the routing device 21 and two bits representing one of the four possible configurations indicated by the minimum total error seeking device 20.

It goes without saying that the invention is not restricted to the examples just described, and that it can take other alternative embodiments depending, notably, on the coefficients that are applied to the filters which may be other than the coefficients $L_{ij}$ defined above, and on the number of these coefficients which may be other than 10. It is also clear that the invention can also be applied to definitions of frame packets including numbers of frames other than three or filtering configurations other than four, and that these alternative embodiments should naturally lead to total numbers of quantification bits other than (33+2) bits with a different distribution by configuration.

What is claimed is:

1. A speech encoding method for the coding of very low bit rate vocoders, comprising the steps of:

cutting up a vocal signal into binary frames of a predetermined duration, grouping together of a predetermined number of frames in packets of successive frames, quantifying the coefficients of a predetermined number of first predictive filters associated with each frame in each packet respectively, quantifying the coefficients of at least one second predictive filter associated to a predetermined combination of frames, selecting the predictive filter for which a predictive error is minimum, and restoring said vocal signal as a speech signal as a function of coefficients of said selected predictive filter.

2. A method according to claim 1, wherein the predetermined number of frames in a packet ranges from 2 to 4 inclusively.

3. A method according to any one of claims 1 or 2 wherein the number of combinations is four, eight or sixteen.

4. A method according to claim 3, wherein the choice of combinations is limited to four:

a first combination where the predictive filters are identical;

a second and third combination where only two predictive filters are identical;

and a fourth combination where all three predictive filters are different.

5. A method according to claim 4 wherein, for each combination, the prediction coefficients and the energy of the prediction error are computed to select only the prediction coefficients for which the prediction error is minimal.

6. A method according to claim 5 wherein, for the computation of the prediction coefficients, a computation is made, in each frame, of the self-correlation coefficients $R_{i,k}$ of the vocal signal sampled, and the algorithm of Leroux-Gueguen or of Schur is applied to determine the reflection coefficients of each predictive filter.

7. A method according to claim 6, wherein the reflection coefficients $L_{i,j}$ of the filters are ten in number and are coded on a total length of 33 bits, irrespectively of the combination.

8. A method according to claim 7, wherein the reflection coefficients $L_1$ to $L_{10}$ of the filters respectively have the following lengths:

(5,5,4,4,4,3,2,2,2,2) bits according to the first combination, (5,4,4,3,3,2,2,2,2,0,0) bits and (3,2,2,1,0,0,0,0,0,0) bits according to the second and third combinations, (4,4,3,3,3,2,2,0,0) bits for the coding of the intermediate frame, the frame 2, according to the fourth combination (3,2,2,1,1,0,0,0,0,0,0) bits for the other two frames, frame 1 and frame 3, according to the fourth combination.

9. A method according to claim 6, wherein the reflection coefficients of the filters are determined by the relationship:

$$L_{i,j}=K_{i,j}/(1-K_{ij}^2)^{31\ 2}$$

wherein $L_{i,j}$ represents the reflection coefficients and $K_{i,j}$ represents the prediction coefficients.

* * * * *